United States Patent [19]

Dinger

[11] 4,292,099

[45] Sep. 29, 1981

[54] METHOD FOR ENVIRONMENTALLY SEALING A WIRE SPLICE

[75] Inventor: Leon J. Dinger, Harrisburg, Pa.

[73] Assignee: AMP Incorporated, Harrisburg, Pa.

[21] Appl. No.: 157,620

[22] Filed: Jun. 9, 1980

Related U.S. Application Data

[62] Division of Ser. No. 19,380, Mar. 12, 1979, abandoned.

[51] Int. Cl.[3] ..... B21F 15/02; H01R 43/00

[52] U.S. Cl. ..... 156/49; 156/86; 156/91; 156/158; 156/196; 156/294; 156/309.6; 174/84 R; 174/87

[58] Field of Search ..... 156/49, 86, 158, 294, 156/309.6, 91, 196; 174/87, 84 R

[56] References Cited

U.S. PATENT DOCUMENTS

| | | | |
|---|---|---|---|
| 2,906,810 | 8/1959 | D'Ascoli | 174/87 |
| 3,243,211 | 3/1966 | Wetmore | 174/87 |
| 4,070,543 | 1/1978 | Thompson | 156/49 |
| 4,195,106 | 3/1980 | Brusselmans | 156/86 |

*Primary Examiner*—Jerome W. Massie
*Attorney, Agent, or Firm*—Allan B. Osborne

[57] ABSTRACT

The present invention relates to a device and method for environmentally sealing a wire splice for use in nuclear power stations and the like. More particularly the device includes three components, an end cap, a sleeve and a separator. The end cap is cross-linked and heat shrinkable. The sleeve and separator fuses under the temperature required for shrinking the end cap. Upon fusing, the sleeve and separator mixes into an impermeable unitary mass in which are embedded the wires.

1 Claim, 6 Drawing Figures

5
10
38
28
12
16
14
18
22
5

6
40
12
38
28
14
16
18
6

12
14
10
18
16
26
22
22

40
42
16
18
42
10

METHOD FOR ENVIRONMENTALLY SEALING A WIRE SPLICE

This is a division of application Ser. No. 19,380, filed Mar. 12, 1979, now abandoned.

BACKGROUND OF THE INVENTION

1. Field of the Invention

This invention relates to sealing or encapsulating a wire splice for use in nuclear power stations and the like.

2. Prior Art

Currently the practice followed in sealing the open ends of tubular members, such as sleeve's and end caps, through which electrical wires pass, is to employ discs having one or more holes. With the wires passing through the holes, the discs block the openings and are fixed to the tubular member in one manner or other. U.S. Pat. Nos. 2,800,523, 3,476,916 and 4,105,481 exemplify the current practice. In U.S. Pat. No. 2,800,523 the holes in sealing plug 11 is made to fit tight about the wires by crimping the plug via inwardly directed ribs on the sleeve. A plug 30 as used in U.S. Pat. No. 3,476,916, is secured in the open end of sheath 20 by crimping the sheath down around it. The wire comes through a centrally positioned hole in the plug. The U.S. Pat. No. 4,105,481 teaches the use of a laminated disc having one or more holes therethrough. The laminations include a layer of polymeric material and a layer of heat foamable adhesive. The tubular member is heat recoverable and upon heating, the adhesive fuses to seal the interface between the disc and tubular member as well as the interfaces between the holes and wires passing therethrough.

SUMMARY OF THE PRESENT INVENTION

The present invention teaches a device and method for environmentally sealing a wire splice in an end cap. The device includes three components: a crosslinked end cap, a sleeve and a separator, the latter two components being fusible in the temperature range required to shrink the end cap.

DESCRIPTION OF THE INVENTION

Figure 1:
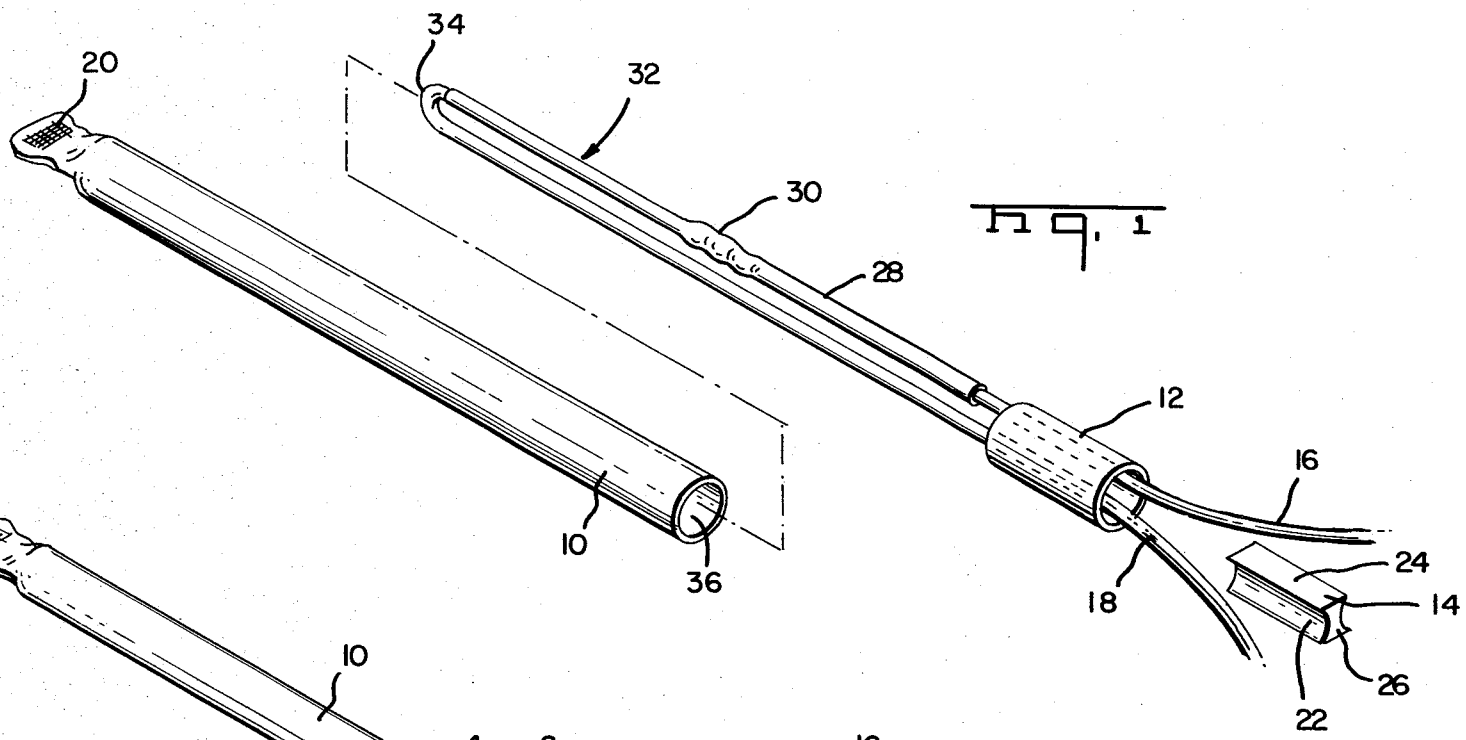
FIG. 1 is a perspective view of the several components of the present invention along with a pair of spliced wires with the spliced section about to be environmentally sealed using the present invention.

FIG. 1 shows the three components of the present invention: a heat shrinkable tubular article having an open end; i.e., an end cap 10, a sleeve 12 and a rectangular block of material forming a separator 14. These three components assembled as set forth below, provide a seal for the spliced wires 16–18 for use inside containment areas of nuclear power stations as well as other environmentally dirty locations.

The three components are made from a polyvinylidene fluoride compound produced and marketed by the Pennwalt Corp. of Philadelphia, Pennsylvania under the trademark "KYNAR". Both sleeve 12 and separator 14 fuses under heat while the material in end cap 10 is cross-linked and thus is infusible under the temperature involved.

One method of making end caps begins with the step of extruding the material into long lengths of tubing having a pre-determined internal diameter. The next step of crosslinking gives the tubing heat deformable, as well as non-fusible, characteristics. Radiation is the cross-linking method preferred. After cross-linking, the tubing is heated, expand radially and quickly cooled to lock it in the expanded condition. This step is well-known in the art and needs no further elaboration. Following the deformation step, the tubing is cut into sleeves of a pre-determined length. The final step is to seal one end of the sleeves. A piece of non-cross-linked KYNAR is placed in one end and the walls pinched down over it. Upon heating the end to 165° C., the piece of KYNAR melts and as it cools, the melted KYNAR solidifies, bonding the pinched walls together. The pinched end is indicated by reference numeral 20 in FIG. 1.

Sleeve 12 is made by extruding the KYNAR material in tubular form and cutting it into proper lengths.

Separator 14 is extruded in the solid shape shown in FIG. 1; i.e., two parallel sides 22 are concave and the adjacent sides 24 are flat. The ends 26 may be squared off as shown or may have any other shape.

As noted above, neither the liner nor separator are cross-linked.

In making an environmentally sealed splice the following steps are taken. First the two wire ends are prepared for splicing by removing a length of insulation. A sleeve 28 of heat deformable material such as thin-wall, heat shrinkable tubing sold by AMP, Inc. of Harrisburg, PA is slipped onto one wire and moved beyond the bared end (not shown). The two wire ends are spliced together, preferably using an uninsulated butt splice connector (not shown) adapted for use in high temperature applications. One such connector is sold by AMP, Inc., under the trademark "STRATOTHERM". After the wires are spliced together, sleeve 28 is centered over the spliced section and shrunk down tightly covering the spliced area, indicated by reference numeral 30 in FIG. 1, as well as a portion of the insulated wires on either side of the spliced area.

Figure 2:
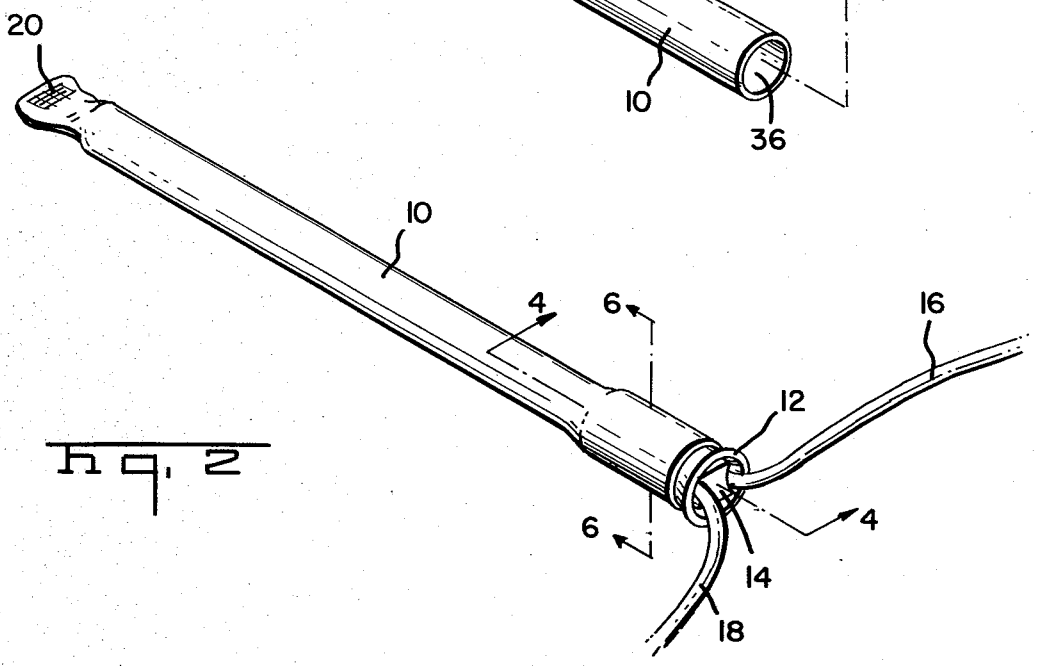
FIG. 2 is a perspective view showing the end cap within which is the spliced section environmentally sealed using the components of FIG. 1.
Figure 3:
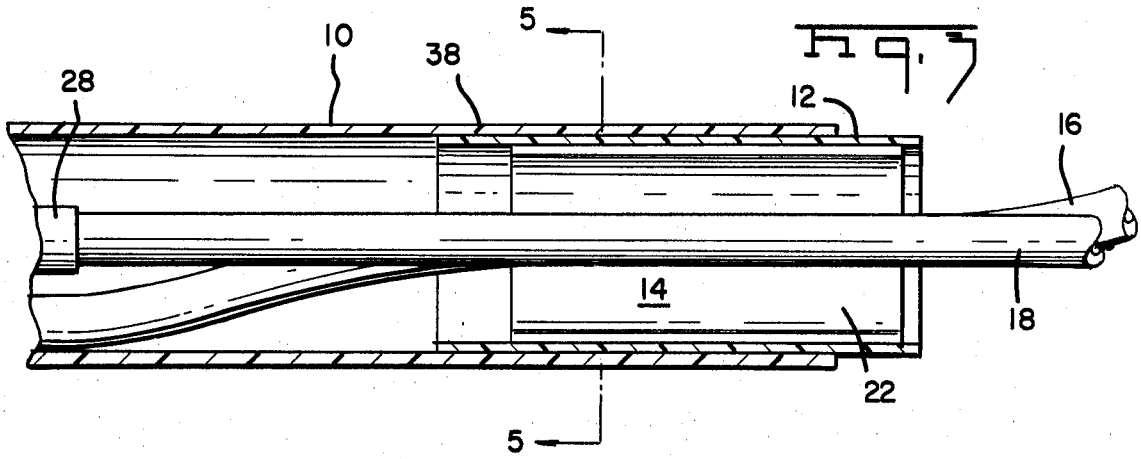
FIG. 3 is a cross-sectional view showing the assembled components before the heat shrinking step.
Figure 4:
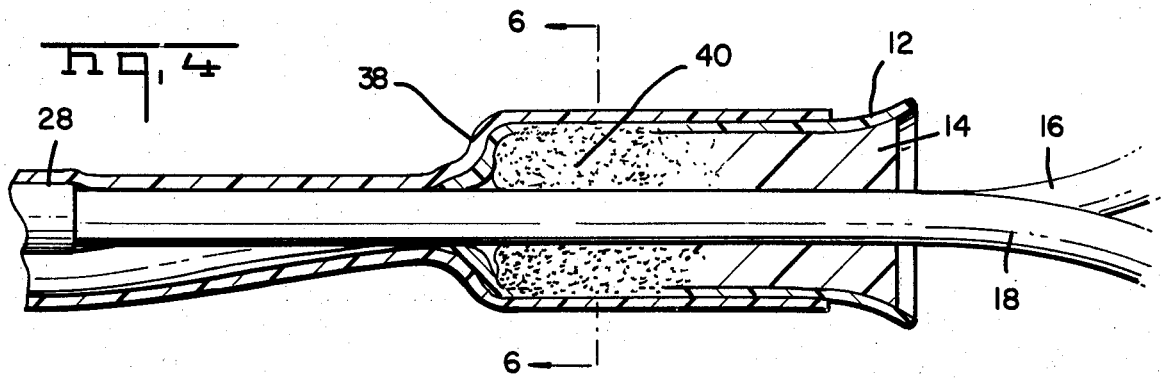
FIG. 4, a cross-sectional view taken along lines 4—4 of FIG. 2, shows the assembled components of FIG. 3 after the heat shrinking step.
Figure 5:
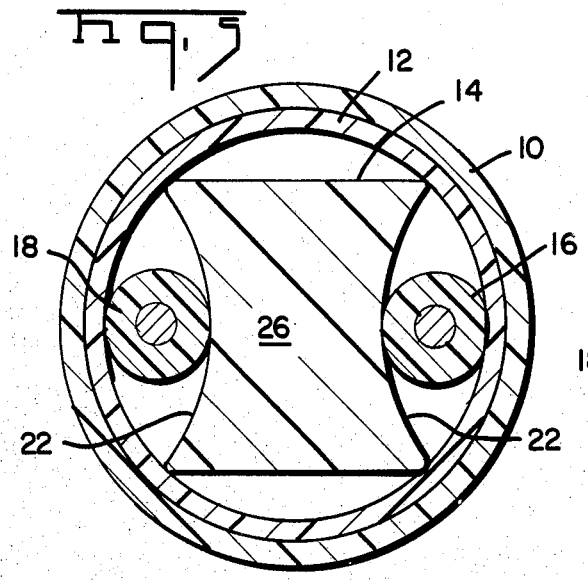
FIG. 5, a cross-sectional view taken along lines 5—5 of FIG. 3, shows the relationship between the components as seen from the open end of the end cap.

The now single or continuous length of wire is bent double; i.e., into an elongated U-shaped section 32 with the bight 34 thereof preferrably not interferring with sleeve 28. Sleeve 12 is slid on over the wires to a point beyond the end of sleeve 28 as shown in FIG. 1. The next step is to slide section 32 into end cap 10, until bight 34 abutts the cap's sealed end 20. Sleeve 12 is then pushed back into the open end 36 of the end cap. If desired, one end of the liner may extend out from the cap as shown in FIGS. 2, 3 and 4. The two wires coming out of the sleeve are spread apart and separator 14 inserted therein between and into the sleeve as shown in FIG. 3. Each wire runs along a concave side 22 as seen in FIG. 5.

Figure 6:
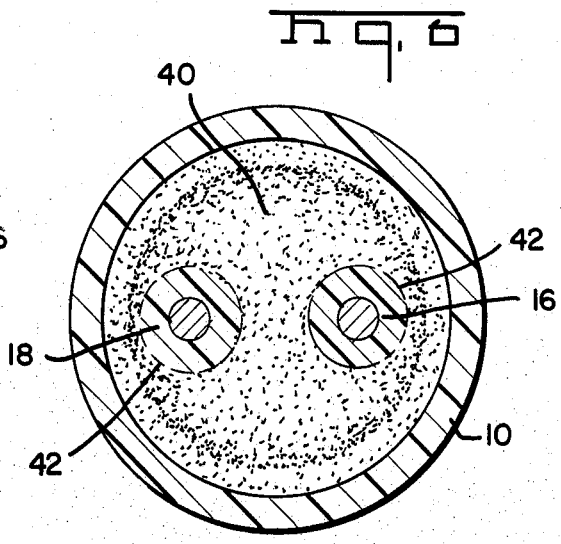
FIG. 6 is a cross-sectional view taken along lines 6—6 of FIG. 4.

With the three components in place, heat is directed at the end cap at the general location of the ends of the sleeve and separator within the cap. This location is indicated generally by a reference numeral 38 in FIGS. 3 and 4. The temperature of the applied heat should be at least 165° C. (350° F.) and preferably about 426° C. (800° F.). The heat causes the end cap to recover in that vicinity and further causes the sleeve and separator at that location within the cap to fuse or melt. At a temperature of about 426° C., the step takes about a minute or slightly less. The fusing of the sleeve and separator accompanied by the compressive force of the shrinking end cap results in the sleeve and separator mixing together and becoming a single unitary mass. This is shown in FIGS. 4 and 6, by the stippling and is indicated generally by reference numeral 40. Further, the heat causes some melting of the wires' outer insulation and a mixing thereof with the fused material of the sleeve and separator. This is indicated by dashed lines 42 in FIG. 6. Although the depth of penetration is not great, it is enough to create an extremely impermeable seal between the wires and the unitary mass.

An impermeable seal is also established between the mass and end cap through the bonding or adhesive properties of the KYNAR in conjunction with the aforementioned compressive force created by the end cap recovering towards it original dimension.

One of the novel aspects of the present invention is separator 14. Its use results in an environmental seal around the wires superior to that obtained using discs with wire receiving apertures therethrough. In addition the assembly is greatly simplified. Further, a separator and sleeve of one dimension will accommodate a larger range of wire signs than will the aforementioned disc.

The foregoing detailed description has been given for clearness of understanding only, and no unnecessary limitations should be understood therefrom, as some modifications will be obvious to those skilled in the art.

What is claimed is:

1. A method of environmentally sealing a wire splice, comprising the steps of:

a. removing insulation from the ends of the two wires to be spliced together;

b. sliding a heat-shrinkable sleeve onto one of said two wires;

c. splicing the two wires together;

d. sliding the heat-shrinkable sleeve to and shrinking it down over the splice area;

e. bending the joined wires into a U-shape and sliding a sleeve of fusible material over the bent wires and past the shrunk sleeve;

f. sliding a heat-shrinkable end cap onto the bent wires with the fusible sleeve positioned in the open end of the end cap;

g. inserting a block of fusible material into the sleeve between the wires; and h. heating the end cap adjacent its open end so that it shrinks down and so that at least a portion of the sleeve and block fuse into a unitary mass with the wires embedded therein and with the end cap being bonded thereto.

* * * * *